US012781976B2

(12) United States Patent
Liu

(10) Patent No.: US 12,781,976 B2
(45) Date of Patent: Nov. 3, 2026

(54) MODULAR AIR CONDITIONER MOUNTING BRACKET

(71) Applicant: Qianwen Liu, Xiamen (CN)

(72) Inventor: Qianwen Liu, Xiamen (CN)

(73) Assignee: Qianwen Liu, Xiamen (CN)

( * ) Notice: Subject to any disclaimer, the term of this patent is extended or adjusted under 35 U.S.C. 154(b) by 0 days.

(21) Appl. No.: 19/370,817

(22) Filed: Oct. 28, 2025

(65) Prior Publication Data

US 2026/0126187 A1 May 7, 2026

(30) Foreign Application Priority Data

Nov. 6, 2024 (CN) ..... 202422704633.2

(51) Int. Cl.
*F24F 1/03* (2019.01)

(52) U.S. Cl.
CPC ..... *F24F 1/03* (2019.02)

(58) Field of Classification Search
CPC .... F24F 1/03; F24F 1/027; F24F 13/32; F24F 13/022; A27H 27/00; F16M 11/00; A47L 3/02; E04G 5/00
See application file for complete search history.

(56) References Cited

U.S. PATENT DOCUMENTS 333,007 A * 12/1885 Greer ..... A47L 3/02 182/53
2,443,242 A * 6/1948 Hansen ..... A47H 1/03 248/279.1
2,891,754 A * 6/1959 Kuhlenschmidt ..... F24F 13/32 62/262
2,940,717 A * 6/1960 Sheaffer ..... A47B 5/04 248/240.4
3,561,714 A * 2/1971 Zurawski ..... A47B 57/06 160/19
4,641,727 A * 2/1987 McKelvy ..... E04G 5/06 182/187
4,667,914 A * 5/1987 Bailey ..... G09F 7/20 248/354.3
4,669,692 A * 6/1987 Mastrodicasa ..... A47B 96/025 211/187
4,949,924 A * 8/1990 Carmody ..... A47H 27/00 248/215
5,062,609 A * 11/1991 Hames ..... A47B 21/0314 248/176.1

(Continued)

*Primary Examiner* — Nkeisha Smith

(57) ABSTRACT

A modular air conditioner mounting bracket is provided, including at least two sets of mutually spaced bracket mechanisms, where each bracket mechanism includes a column, a support assembly, and a detachable connecting member, the column is provided with a plurality of first mounting channels, and the support assembly is provided with at least one second mounting channel; the support assembly is provided at a bottom end of the column through the detachable connecting member, and an extension direction of the support assembly is perpendicular to an extension direction of the column; the support assembly includes a first support, a second support, and a limiting member, an adjustment channel is provided within the first support, the second support is inserted into the adjustment channel, and the limiting member is inserted into the first support and the second support.

10 Claims, 9 Drawing Sheets

(56) References Cited

U.S. PATENT DOCUMENTS 5,678,794 A * 10/1997 Kump ..... A47F 5/0869 248/220.31
6,082,690 A * 7/2000 Durin ..... H02G 3/263 211/90.01
7,490,424 B2 * 2/2009 Caterinacci ..... G09F 7/20 40/606.14
8,434,629 B2 * 5/2013 Fernandez ..... A47B 96/067 211/94.01
8,550,259 B1 * 10/2013 McCoy ..... H02G 3/30 211/13.1
9,022,335 B2 * 5/2015 Randazzo ..... F16M 13/022 248/288.11
10,426,263 B1 * 10/2019 Whaley ..... A47B 77/14
10,743,437 B2 * 8/2020 Ankarbjörk ..... F16M 13/02
11,168,921 B2 * 11/2021 Marini ..... F16B 5/126
11,199,332 B2 * 12/2021 Roverato ..... F16M 13/022
11,205,529 B1 * 12/2021 Rogerson ..... H01B 17/14
11,339,993 B2 * 5/2022 Zhao ..... F24F 13/32
11,489,325 B2 * 11/2022 McCoy ..... F16L 3/137
12,085,304 B2 * 9/2024 Si ..... F24F 1/031
12,571,545 B2 * 3/2026 Lu ..... F24F 1/0003
2005/0178941 A1 * 8/2005 Burns ..... F16M 11/10 248/475.1
2011/0198461 A1 * 8/2011 Truckor ..... F16M 11/30 248/205.1
2011/0303798 A1 * 12/2011 Bader ..... A47F 5/0846 248/65
2012/0085721 A1 * 4/2012 Michael J ..... A47F 5/0853 211/103
2013/0153744 A1 * 6/2013 Jin ..... F24F 13/32 248/670
2016/0123625 A1 * 5/2016 Crowley ..... E04G 5/062 248/201
2018/0132611 A1 * 5/2018 Lu ..... A47B 61/003
2020/0400321 A1 * 12/2020 Bosa ..... F24F 1/62
2025/0164122 A1 * 5/2025 Lei ..... F24F 1/027

* cited by examiner

MODULAR AIR CONDITIONER MOUNTING BRACKET

CROSS REFERENCE TO THE RELATED APPLICATIONS

This application is based upon and claims priority to Chinese Patent Application No. 202422704633.2, filed on Nov. 6, 2024, the entire contents of which are incorporated herein by reference.

TECHNICAL FIELD

The present invention relates to the field of air conditioner brackets, specifically, to a modular air conditioner mounting bracket.

BACKGROUND

An air conditioner mounting bracket, also known as an air conditioner support bracket, is a key component used to support and secure air conditioning equipment and plays a vital role in an air conditioning system. It ensures the stability and safety of the air-conditioner outdoor unit and meanwhile impacts the air conditioner's service life.

Structurally, there are diverse types of air conditioner brackets. Fixed bracket is typically composed of angle bracket and support bracket, with an L- or T-shaped structure, and used for fixation to a wall or ground to bear the weight of the air-conditioner outdoor unit. Cantilever bracket is used to suspend the air-conditioner outdoor unit from a wall through an arm structure and suitable for applications requiring a suspended installation. Furthermore, mobile bracket, which is equipped with rollers or rails, allows for easy movement of air conditioner equipment, meeting the requirement of flexible adjustment of air conditioner position.

For example, the invention patent, with the application number CN202010516461.X, entitled "Air Conditioner Mounting Bracket", discloses its use process as follows: before placing the air-conditioner outdoor unit on the auxiliary rod, sliding two anti-slip rods so that the distance between the two anti-slip rods corresponds to the width of the air-conditioner outdoor unit, and tightening positioning bolts to prevent the anti-slip rods from sliding, after placing the air-conditioner outdoor unit between the two anti-slip rods, connecting the air-conditioner outdoor unit to the auxiliary rod by bolts while the air-conditioner outdoor unit is not easily slidable, making it easier for people to connect the air-conditioner outdoor unit to the auxiliary rod. However, the overall structure is complex, resulting in a large packaging volume and a high express delivery cost.

SUMMARY

The objective of the present invention is to provide a modular air conditioner mounting bracket, aiming to improve the problem that the overall structure of conventional air conditioner mounting brackets is so complex that results in a large product packaging volume and a high express delivery cost.

To achieve the above objective, the present invention adopts the following technical solution:

A modular air conditioner mounting bracket, including at least two sets of mutually spaced bracket mechanisms. Each bracket mechanism includes a column, a support assembly, and a detachable connecting member. The column is provided with a plurality of first mounting channels, and the support assembly is provided with second mounting channel (s).

The support assembly is provided at the bottom end of the column through the detachable connecting member, and the extension direction of the support assembly is perpendicular to the extension direction of the column. The support assembly includes a first support, a second support, and a limiting member. An adjustment channel is provided within the first support, and the second support is inserted into the adjustment channel. The limiting member is inserted into the first support and the second support.

Further, mounting crossbar(s) is/are provided at the top end of the column. The mounting crossbar is provided with a third mounting channel. One ends of two mounting crossbars abut against each other and are secured by a connecting block. A level gauge is provided on the connecting block.

Further, the top end of the column is provided with at least one limiting notch, the mounting crossbar is provided with a limiting portion, and the limiting portion is embedded in the limiting notch.

Further, a first hanging channel is provided on the inner side of the top end of the column, and the mounting crossbar is inserted into the first hanging channel. The limiting notch is provided at the top end and/or bottom end of the first hanging channel and communicated with the first hanging channel.

Further, there are two limiting notches and two limiting portions, and the two limiting notches are respectively provided at the top end and bottom end of the first hanging channel.

The limiting notch is an arc notch, and the free end of the arc notch is bent toward the inner side of the column. The limiting portion is an arc limiting portion, and the arc limiting portion is embedded in the arc notch.

Further, the mounting crossbar includes a first vertical plate, and the top end and bottom end of the first vertical plate both extend outward to form first horizontal plates.

The connecting block includes a first body, and two outwardly extending support plates are fixed to the inner side of the first body. The two support plates are respectively in contact with and arranged on the inner side surfaces of the two first horizontal plates.

The upper and lower ends of the first body are both provided with bending limiting arms, and each bending limiting arm is bent toward the inner side of the column and wrapped around the arc limiting portion.

At least two first locking channels are provided on the first body, and the first locking channels and the mounting crossbars are in a one-to-one correspondence.

Further, a second hanging channel is provided on the inner side of the top end of the column, and the limiting notch is located below the second hanging channel.

The mounting crossbar includes a second vertical plate, and the top and bottom ends of the second vertical plate both extend outward to form a second horizontal plate and a third horizontal plate. The second horizontal plate extends to the inside of the second hanging channel, and abuts against and contacts the inner top of the second hanging channel. The second vertical plate is arranged on and in contact with the inner side of the column. The third horizontal plate extends to the inside of the limiting notch, the limiting notch is provided with a bending limiting portion, the free end of the third horizontal plate is provided with a bent plate, and the bent plate is embedded in the bending limiting portion.

Further, the bottom end of the bending limiting portion extends upward toward the outside of the column.

Further, the connecting block includes a second body. The upper and lower ends of the second body are respectively provided with a first abutting portion and a second abutting portion. The first abutting portion and the second abutting portion respectively abut against the inner sides of the second horizontal plate and the third horizontal plate. The free end of the second abutting portion is provided with a fitting portion, and the fitting portion fits the bent plate.

Further, two sides of the bottom of the first support are provided with first guide plates. The first guide plates extend horizontally to the lower channel opening of the adjustment channel. Two sides of the bottom of the second support are provided with second guide plates. The second guide plates extend horizontally relative to each other. The bottom surfaces of the second guide plates abut against and contact the top surfaces of the first guide plates.

Further, insertion notches are provided on two sides of the bottom end of the channel opening of the adjustment channel facing the second support. The top of the insertion notch tilts downward from the channel opening of the adjustment channel, and the first guide plates extend from the bottom ends of the insertion notches to the other end of the first support.

By employing the above technical solution, the present invention has the following advantages compared with the prior art:

1. The column is fixedly connected to a mounting surface and a to-be-mounted device through the first mounting channels and the bolts, and the support assembly is fixedly connected to the to-be-mounted device through the second mounting channel and the bolts; the support assembly is detachably secured to the column by the detachable connecting member, and the first support and the second support are detachably secured by the limiting member. These structures can be mutually disassembled and assembled with each other, and the overall structure is simple and effective. On the premise of meeting the mounting requirements of the to-be-mounted device, the overall packaging volume is effectively reduced and the transportation cost is reduced.
2. At the same time, the second support is inserted into the adjustment channel of the first support, and the second support is limited by the limiting member. During the actual installation process, the protruding distance of the second support can be flexibly adjusted to achieve the adjustment of the size of the modular air conditioner mounting bracket to meet the mounting requirements of to-be-mounted devices of different sizes, possessing better flexibility.
3. The provision of two mounting crossbars that abut against each other at one ends and are connected via the connecting block reduces the length of the mounting crossbar, further reducing the overall packaging size and the transportation cost. The arrangement of the level gauge on the connecting block effectively improves the assembly efficiency of the mounting crossbars, maintaining the mounting crossbars horizontal. The mounting crossbars play a positioning role on the columns at two ends, ensuring that the top surfaces of the two support assemblies installed on the columns are at the same level, so that the to-be-mounted device is more stable after installation.

ILLUSTRATION OF REFERENCE NUMERALS

Figure 1:
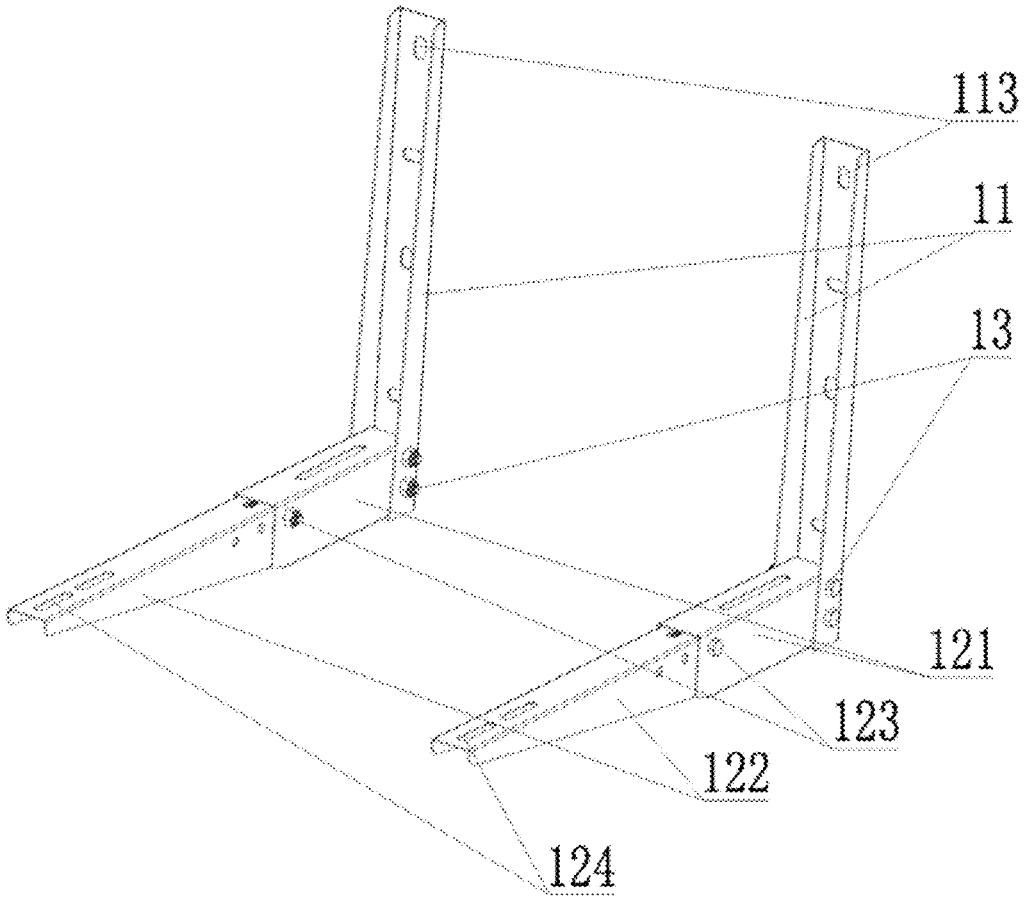
FIG. 1 is a structural diagram of a modular air conditioner mounting bracket according to Embodiment 1.

1. bracket mechanism; 11. column; 111. column panel; 112. first mounting plate; 1121. first mounting hole; 113. first mounting channel; 114. mounting space; 115. limiting channel; 1151. arc notch; 1152. bending limiting portion; 116. first hanging channel; 117. second hanging channel; 12. support assembly; 121. first support; 1211. adjustment channel; 1212. first support panel; 1213. second mounting plate; 1214. second mounting hole; 1215. first guide plate; 1216. insertion notch; 122. second support; 1221. second support panel; 1222. third mounting plate; 1223. adjustment hole; 1224. second guide plate; 123. limiting member; 124. second mounting channel; 13. detachable connecting member; 131. bolt; 132. nut;

2. mounting crossbar; 21. third mounting channel; 22. arc limiting portion; 23. first vertical plate; 24. first horizontal plate; 25. second vertical plate; 26. second horizontal plate; 27. third horizontal plate; 271. bent plate;

3. connecting block; 31. first body; 311. support plate; 312. bending limiting arm; 313. first embedding channel; 314. first locking channel; 32. second body; 321. first abutting portion; 322. second abutting portion; 323. fitting portion; 324. second embedding channel; 325. second locking channel; 4. level gauge.

DETAILED DESCRIPTION OF THE EMBODIMENTS

To make the objective, technical solutions and advantages of the present invention more clearly understood, the present invention is further described in detail below with reference to the accompanying drawings and embodiments. It should be understood that the specific embodiments described herein are only used to explain the present invention and are not intended to limit the present invention.

In addition, it should be noted that the terms "up", "down", "left", "right", "vertical", "horizontal", "inside/inner", "outside/outer", etc. are all based on the orientation or position relationship shown in the accompanying drawings, are only for the convenience of describing the present invention and simplifying the description, do not indicate or imply that the device or element of the present invention must have a specific orientation, and therefore, cannot be understood as a limitation on the present invention.

When an element is described as being "fixed to" or "disposed/arranged on" or "provided on" another element, it can be directly or indirectly on the another element. When an element is described as being "connected to" another element, it can be directly or indirectly connected to the another element.

Unless otherwise expressly specified or limited, the terms "mounted/installed", "linked/communicated", and "connected" should be understood in a broad sense. For example, it may refer to fixed connection, detachable connection, or integrated connection; mechanical connection or electrical connection; direct connection or indirect connection through an intermediate medium; and internal communication between two elements or interaction between two elements. Those skilled in the art will understand the specific meanings of the above terms in the present invention based on the specific circumstances.

Embodiment 1

Figure 2:
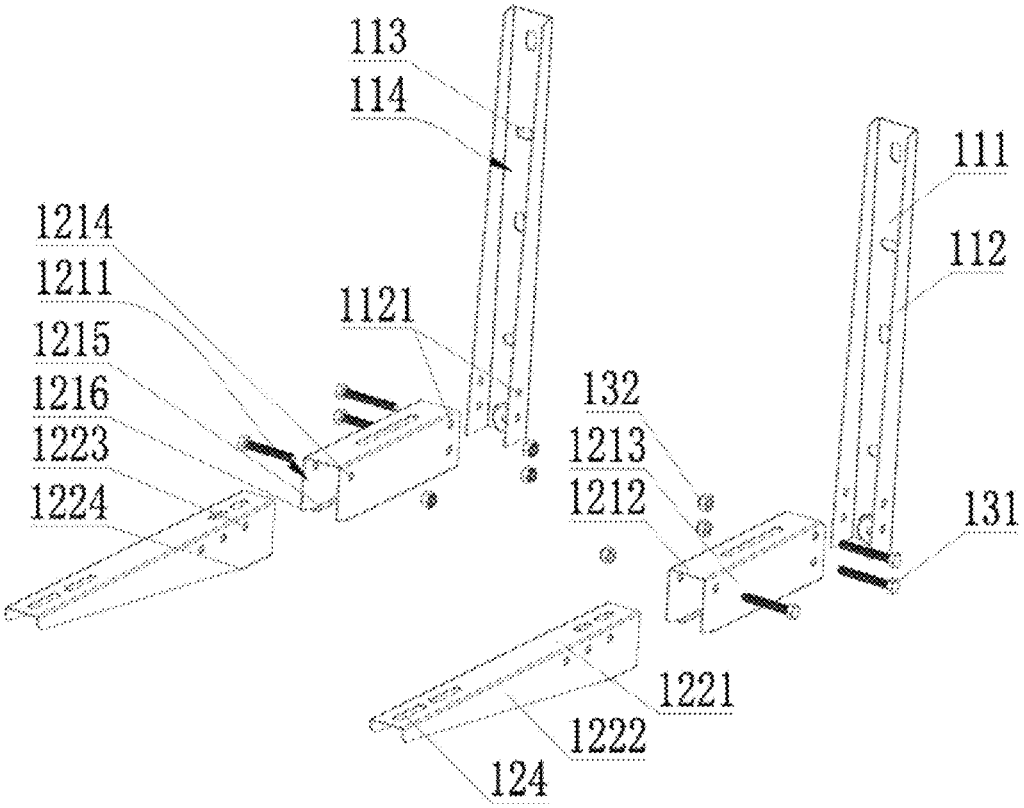
FIG. 2 is an exploded view of the modular air conditioner mounting bracket according to Embodiment 1.
Figure 3:
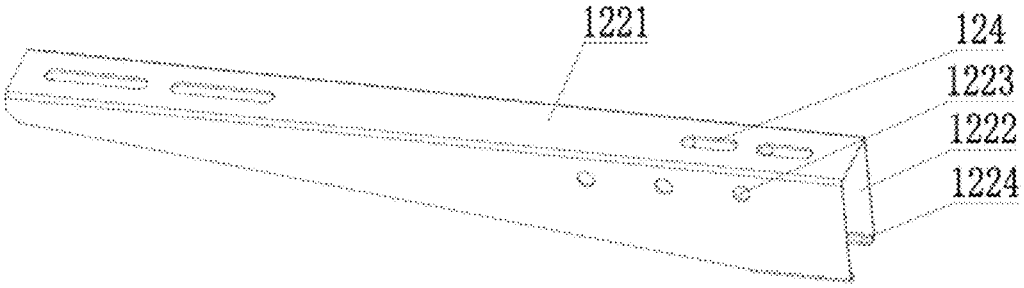
FIG. 3 is a structural diagram showing the second support of the modular air conditioner mounting bracket according to Embodiment 1.
Figure 4:
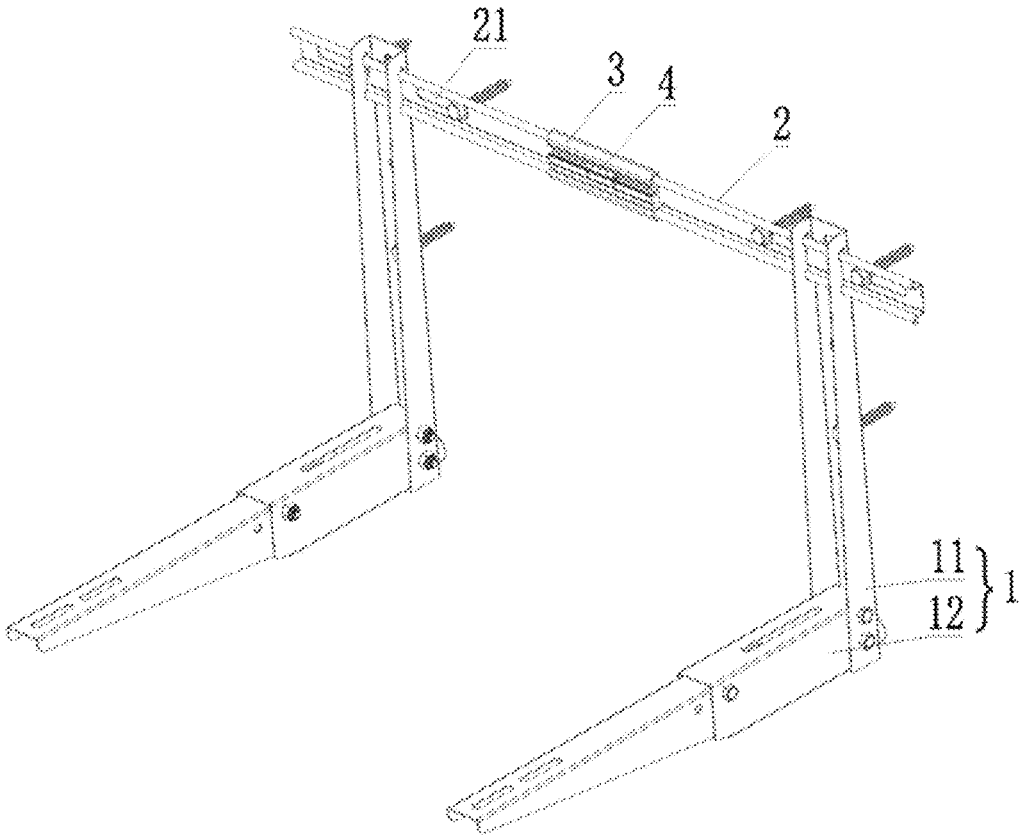
FIG. 4 is a structural diagram of a modular air conditioner mounting bracket according to Embodiment 2.
Figure 5:
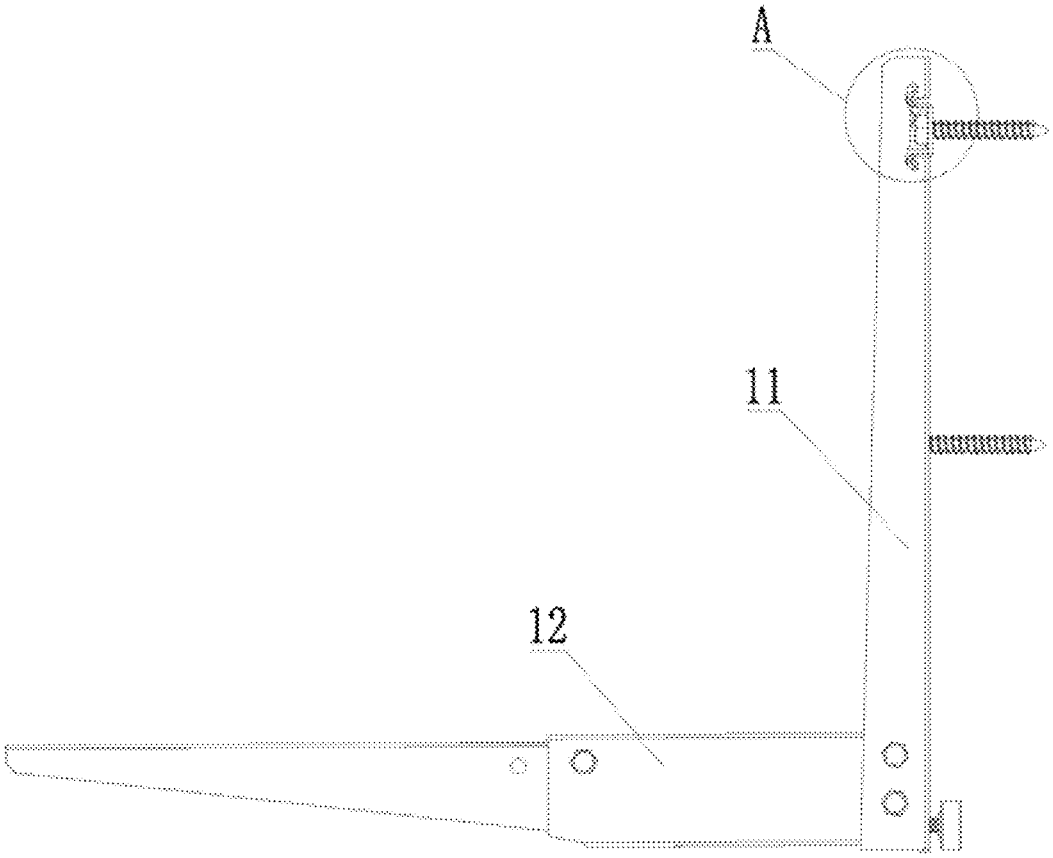
FIG. 5 is a side view of the modular air conditioner mounting bracket according to Embodiment 2.
Figure 6:
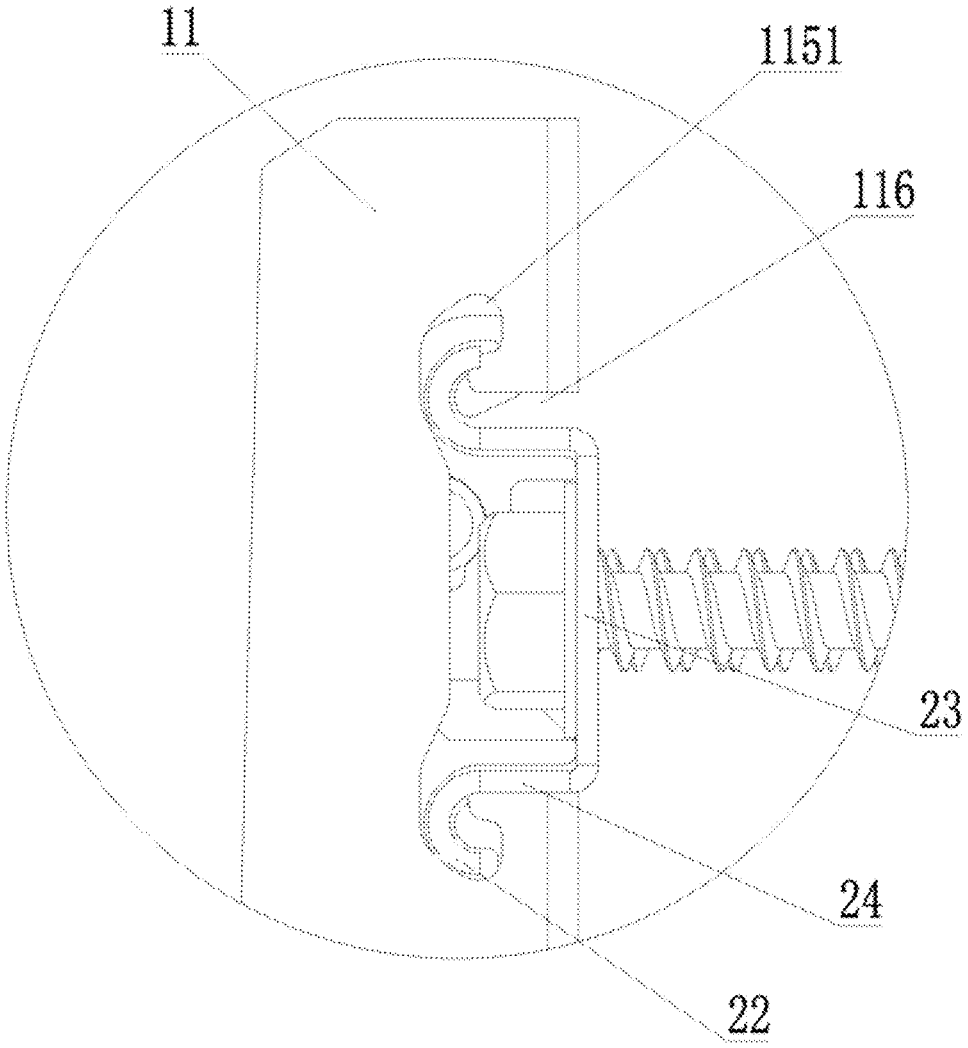
FIG. 6 is an enlarged view showing the portion A of the modular air conditioner mounting bracket according to Embodiment 2.
Figure 7:
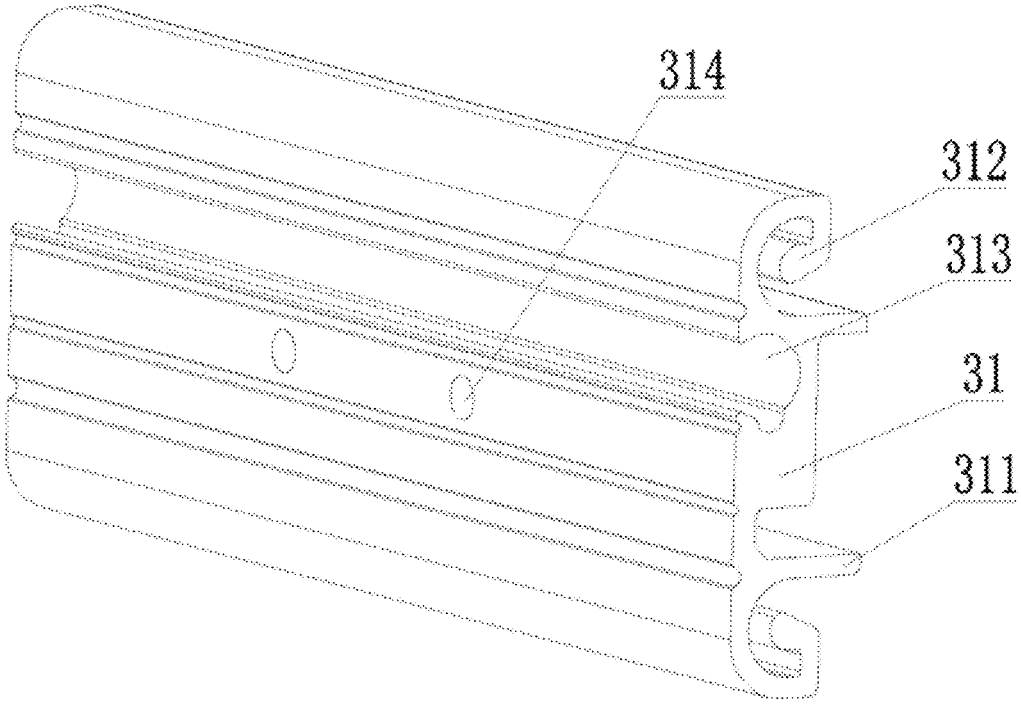
FIG. 7 is a structural diagram of the connecting block of the modular air conditioner mounting bracket according to Embodiment 2.
Figure 8:
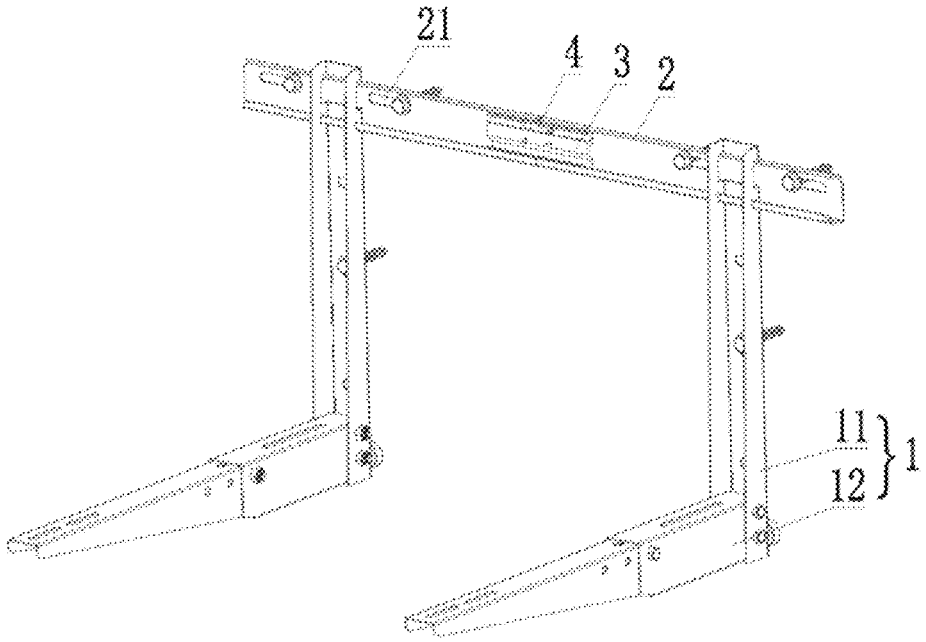
FIG. 8 is a structural diagram of a modular air conditioner mounting bracket according to Embodiment 3.
Figure 9:
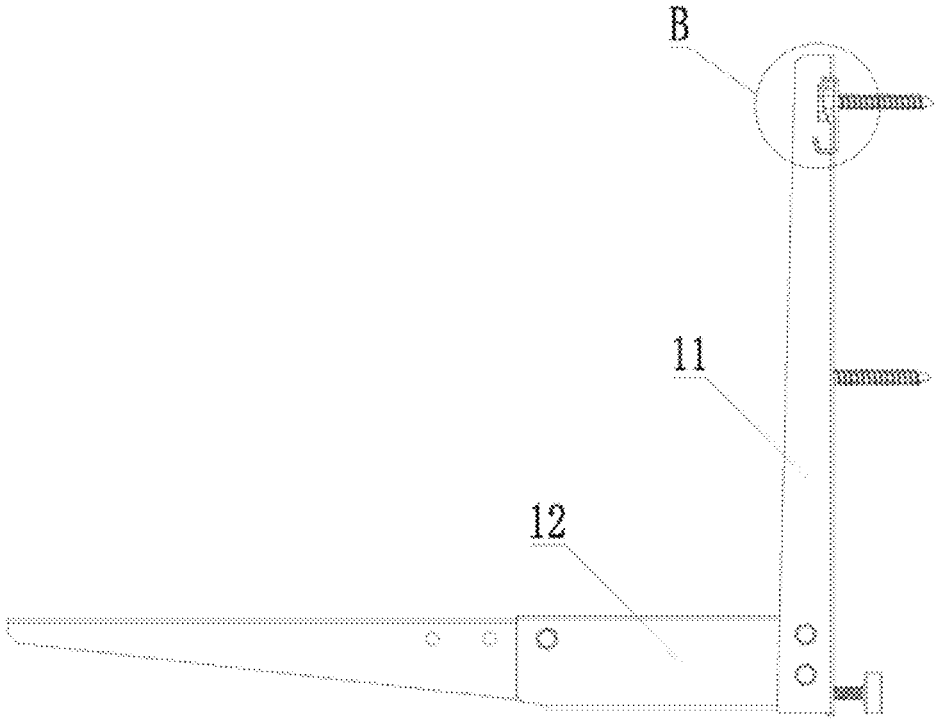
FIG. 9 is a side view of the modular air conditioner mounting bracket according to Embodiment 3.
Figure 10:
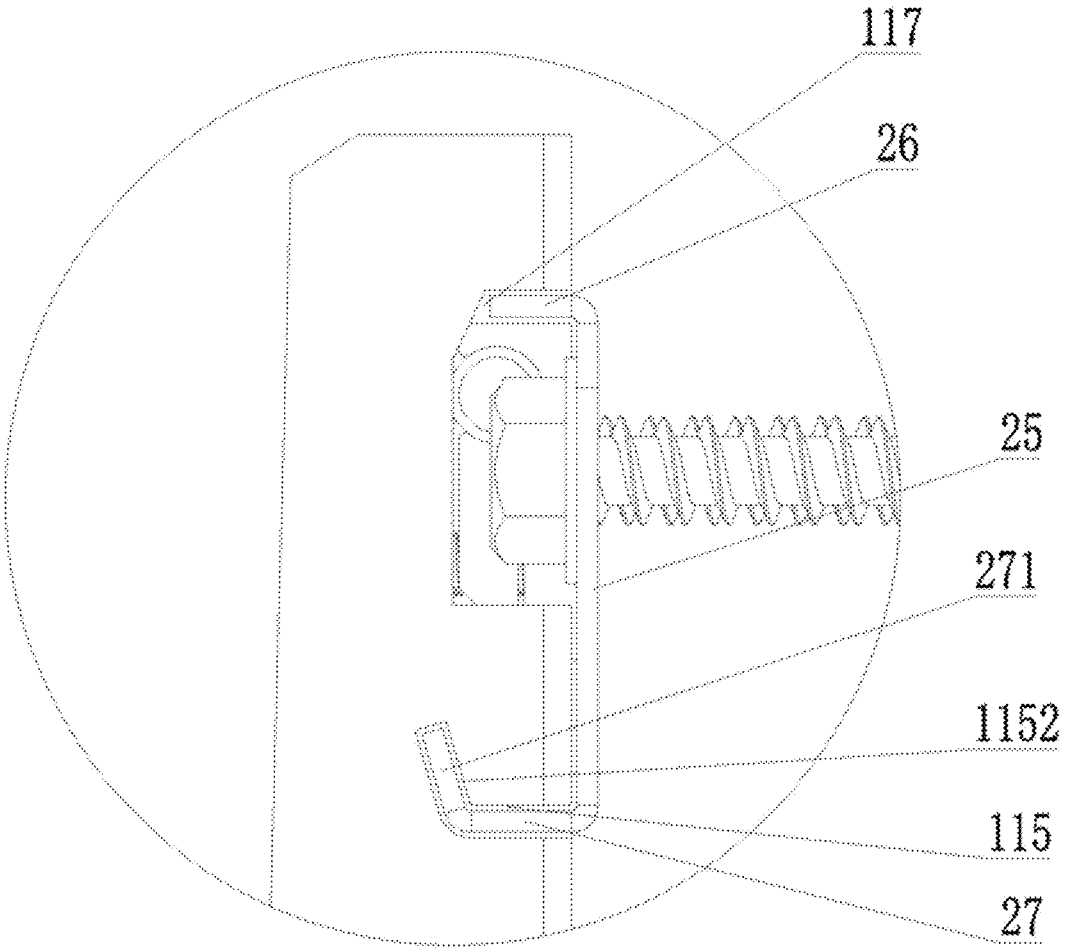
FIG. 10 is an enlarged view showing the portion B of the modular air conditioner mounting bracket according to Embodiment 3.
Figure 11:
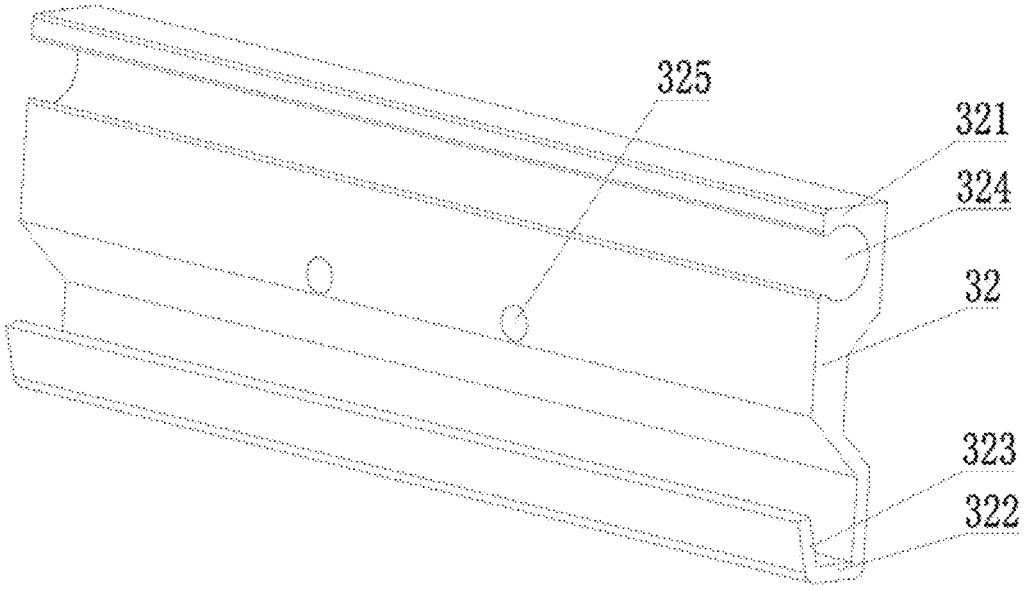
FIG. 11 is a structural diagram of the connecting block of the modular air conditioner mounting bracket according to Embodiment 3.

Referring to FIGS. 1-3, the present embodiment provides a modular air conditioner mounting bracket, including at least two sets of mutually spaced bracket mechanisms 1. In the present embodiment, the number of the bracket mechanisms 1 is two. Similarly, the number of the bracket mechanisms 1 can also be three or more. Two bracket mechanisms 1 are provided on two sides to support an air-conditioner outdoor unit or other devices, effectively ensuring the stability of equipment after installation. The bracket mechanism 1 includes a column 11, a support assembly 12, and a detachable connecting member 13. The column 11 is provided with a plurality of first mounting channels 113, and the support assembly 12 is provided with second mounting channel(s) 124. The support assembly 12 is provided at the bottom end of the column 11 through the detachable connecting member 13, and the extension direction of the support assembly 12 is perpendicular to the extension direction of the column 11. The support assembly 12 includes a first support 121, a second support 122, and a limiting member 123. An adjustment channel 1211 is provided within the first support 121, and the second support 122 is inserted into the adjustment channel 1211. The limiting member 123 is inserted into the first support 121 and the second support 122. In the present embodiment, the detachable connecting member 13 and the limiting member 123 are each a structure composed of a bolt 131 and a nut 132. Similarly, other detachable connecting members may also be used.

In the present embodiment, the column 11 includes a column panel 111, and the first mounting channels 113 are defined on the column panel 111. Two sides of the column panel 111 extend outward to form first mounting plates 112. The column panel 111 and the first mounting plates 112 are all vertically arranged and define a mounting space 114. The end of the first support 121 enters the mounting space 114 and abuts against the column panel 111. Simultaneously, the first mounting plates 112 on two sides fit two sides of the first support 121.

Furthermore, the first support 121 includes a first support panel 1212, and the first support panel 1212 is horizontally arranged. Two sides of the first support panel 1212 extend downward to form second mounting plates 1213. The first support panel 1212 and the second mounting plates 1213 define an adjustment channel 1211. The bottom ends of the first mounting plates 112 and the second mounting plates 1213 are in contact with each other, and the bottom ends of the first mounting plates 112 and one ends of the second mounting plates 1213 are each provided with at least two first mounting holes 1121. The detachable connecting member 13 passes through the first mounting holes 1121 to achieve a detachable connection between the first support 121 and the column 11. In the present embodiment, the number of the first mounting holes 1121 is two, and similarly, the number of the first mounting holes 1121 can also be three or more. Providing two first mounting holes 1121 for mounting the first support 121 effectively maintains the horizontality of the first support 121 and prevents the first support 121 from rotating and deviating after installation, maintaining the stability of equipment after installation.

In the present embodiment, the second support 122 includes a second support panel 1221, and the second mounting channel 124 is defined on the first support panel 1212 and the second support panel 1221. The second support panel 1221 is arranged horizontally, and two sides of the second support panel 1221 extend downward to form third mounting plates 1222. One ends of the second support panel 1221 and the third mounting plates 1222 are inserted into the adjustment channel 1211. The other ends of the second mounting plates 1213 are each provided with at least one second mounting hole 1214, and the ends of the third mounting plates 1222 proximal to the column 11 are each provided with at least two adjustment holes 1223. The adjustment holes 1223 are arranged in a row horizontally and located at the same level as the second mounting hole 1214. The limiting member 123 passes through the second mounting hole 1214 and one adjustment hole 1223 to achieve a detachable connection between the second support 122 and the first support 121. By passing through different adjustment holes 1223, the length of the second support 122 protruding from the adjustment channel 1211 can be adjusted, thereby adjusting the overall size of the mounting bracket. In the present embodiment, there is one second mounting hole 1214 and three adjustment holes 1223. Similarly, the number of the second mounting holes 1214 and the number of the adjustment holes 1223 can also be two or more.

The column 11 is fixedly connected to a mounting surface and a to-be-mounted device through the first mounting channels 113 and the bolts 131, and the support assembly is fixedly connected to the to-be-mounted device through the second mounting channel 124 and the bolts 131; the support assembly 12 is detachably secured to the column 11 by the detachable connecting member 13, and the first support 121 and the second support 122 are detachably secured by the limiting member 123. These structures can be mutually disassembled and assembled with each other, and the overall structure is simple and effective. On the premise of meeting the mounting requirements of the to-be-mounted device, the overall packaging volume is effectively reduced and the transportation cost is reduced.

At the same time, the second support 122 is inserted into the adjustment channel 1211 of the first support 121, and the second support 122 is limited by the limiting member 123. During the actual installation process, the protruding distance of the second support 122 can be flexibly adjusted to achieve the adjustment of the size of the modular air conditioner mounting bracket to meet the mounting requirements of to-be-mounted devices of different sizes, possessing better flexibility.

In the present embodiment, two sides of the bottom of the first support 121 are provided with first guide plates 1215. The first guide plates 1215 extend horizontally to the lower channel opening of the adjustment channel 1211. Two sides of the bottom of the second support 122 are provided with second guide plates 1224. The second guide plates 1224 extend horizontally relative to each other. The bottom surfaces of the second guide plates 1224 abut against and contact the top surfaces of the first guide plates 1215. That is, the first guide plates 1215 are provided at the bottom ends of the second mounting plates 1213 and extend relative to each other; the second guide plates 1224 are provided at the bottom ends of the second support 122 and extend relative to each other. The second guide plates 1224 guide the second support 122 to ensure the accuracy of movement of the second support 122 during adjustment. Additionally, they also play a role of supporting the second support 122, supporting the second support 122 from below and improving the structural strength of the overall bracket.

Furthermore, insertion notches 1216 are provided on two sides of the bottom end of the channel opening of the adjustment channel 1211 facing the second support 122. The top of the insertion notch 1216 tilts downward from the channel opening of the adjustment channel 1211, and the first guide plates 1215 extend from the bottom ends of the insertion notches 1216 to the other end of the first support 121. That is, the insertion notches 1216 are provided at the bottom ends of the second mounting plates 1213 away from the column 11. The insertion notches 1216 make way for the second support 122, shortening the length of the first guide plate 1215 and enlarging the channel opening of the adjustment channel 1211. This facilitates the insertion and installation of the second support 122, thereby improving assembly efficiency.

Embodiment 2

Referring to FIGS. 4-7, the present embodiment provides a modular air conditioner mounting bracket. The modular air conditioner mounting bracket described in the present embodiment has the same structure as that described in Embodiment 1, except that mounting crossbars 2 are provided at the top end of the columns 11. The mounting crossbar 2 is provided with a third mounting channel 21. The mounting crossbar 2 is fixedly connected to a to-be-mounted surface via the third mounting channel 21 and the bolts 131. One ends of the two mounting crossbars 2 abut against each other and are secured by a connecting block 3. A level gauge 4 is provided on the connecting block 3. The provision of two mounting crossbars 2 that abut against each other at one ends and are connected via the connecting block 3 reduces the length of the mounting crossbar 2, further reducing the overall packaging size and the transportation cost. The arrangement of the level gauge 4 on the connecting block 3 facilitates leveling the entire mounting bracket during the installation process, ensuring the horizontality of the to-be-mounted device after installation, and improving assembly efficiency.

The top end of the column 11 is provided with at least one limiting notch, the mounting crossbar 2 is provided with a limiting portion, and the limiting portion is embedded in the limiting notch. The mounting crossbar 2 supports the column 11 through the limiting notch and the limiting portion. A first hanging channel 116 is provided on the inner side of the top end of the column 11, and the mounting crossbar 2 is inserted into the first hanging channel 116. The limiting notch is provided at the top end and/or bottom end of the first hanging channel 116 and communicated with the first hanging channel 116. The first hanging channel 116 allows the mounting crossbar 2 to pass through, supports the mounting crossbar 2, and ensures the stability of connection between the mounting crossbar and the column 11. In the present embodiment, there are two limiting notches and two limiting portions, and the two limiting notches are respectively provided at the top end and bottom end of the first hanging channel 116. The mounting crossbar 2 is limited by the two limiting notches at the top and bottom ends, which maximizes the stability of the mounting crossbar 2 after installation. Similarly, the number of the limiting notch and the number of the limiting portion can also be one, and the limiting notch is provided at the top end or bottom end of the first hanging channel 116. The limiting notch is an arc notch 1151, and the free end of the arc notch 1151 is bent toward the inner side of the column 11. The limiting portion is an arc limiting portion 22, and the arc limiting portion 22 is embedded in the arc notch 1151. The limiting notch limits the arc limiting portion 22 from multiple directions, further ensuring the stability of connection between the two.

Specifically, the mounting crossbar 2 includes a first vertical plate 23, the top end and bottom end of the first vertical plate 23 both extend outward to form first horizontal plates 24, and the arc limiting portion 22 is provided at the free end of the first horizontal plate 24. In the present embodiment, the connecting block 3 includes a first body 31, and two outwardly extending support plates 311 are fixed to the inner side of the first body 31. The two support plates 311 are respectively in contact with and arranged on the inner side surfaces of the two first horizontal plates 24. The support plates 311 are in contact with the mounting crossbar 2 at the upper and lower sides to limit the position of the first body 31 and ensure the stability of the first body 31 after installation. Furthermore, the upper and lower ends of the first body 31 are both provided with bending limiting arms 312, and each bending limiting arm is bent toward the inner side of the column 11 and wrapped around the arc limiting portion 22. The bending limiting arm 312 wraps around the arc limiting portion 22 from the upper and lower ends, forming a "claw" shaped connection structure, which is engaged onto the two mounting crossbars 2 to ensure the tightness of connection between the connecting block 3 and the mounting crossbars 2. At least two first locking channels 314 are provided on the first body 31, and the first locking channels 314 and the mounting crossbars 2 are in a one-to-one correspondence. In the present embodiment, the number of the first locking channels 314 is two, and similarly, the number of the first locking channels 314 can also be three or more. The connecting block 3 and the two mounting crossbars 2 are fixedly connected through the first locking channels 314 and the bolts 131 to ensure the tightness of connection between the two mounting crossbars 2.

In the present embodiment, a first embedding channel 313 is provided on the first body 31, and the level gauge 4 is embedded in the first embedding channel 313.

Embodiment 3

Referring to FIGS. 8-11, the present embodiment provides a modular air conditioner mounting bracket. The modular air conditioner mounting bracket described in the present embodiment has the same structure as that described in Embodiment 1, except that mounting crossbars 2 are provided at the top end of the columns 11. The mounting crossbar 2 is provided with a third mounting channel 21. The mounting crossbar 2 is fixedly connected to a to-be-mounted surface via the third mounting channel 21 and the bolts 131. One ends of the two mounting crossbars 2 abut against each other and are secured by a connecting block 3. A level gauge 4 is provided on the connecting block 3. The provision of two mounting crossbars 2 that abut against each other at one ends and are connected via the connecting block 3 reduces the length of the mounting crossbar 2, further reducing the overall packaging size and the transportation cost. The arrangement of the level gauge 4 on the connecting block 3 facilitates leveling the entire mounting bracket during the installation process, ensuring the horizontality of the to-be-mounted device after installation, and improving assembly efficiency.

The top end of the column 11 is provided with at least one limiting notch, the mounting crossbar 2 is provided with a limiting portion, and the limiting portion is embedded in the limiting notch. The mounting crossbar 2 supports the column 11 through the limiting notch and the limiting portion. In the present embodiment, a second hanging channel 117 is provided on the inner side of the top end of the column 11, the number of the limiting channel 115 is one, and the limiting notch is located below the second hanging channel 117. In the present embodiment, the mounting crossbar 2 includes a second vertical plate 25, and the top and bottom ends of the second vertical plate 25 both extend outward to form a second horizontal plate 26 and a third horizontal plate 27. The second horizontal plate 26 extends to the inside of the second hanging channel 117, and abuts against and contacts the inner top of the second hanging channel 117. The second horizontal plate 26 is planarly connected to the limiting notch of the column 11, providing stable support for the column 11. The second vertical plate 25 is arranged on and in contact with the inner side surface of the column 11. The provision of a larger second vertical plate 25 increases the contact area between the second vertical plate 25 and the column 11. The third horizontal plate 27 extends to the inside of the limiting notch, the limiting notch is provided with a bending limiting portion 1152, the free end of the third horizontal plate 27 is provided with a bent plate 271, and the bent plate 271 is embedded in the bending limiting portion 1152. In the present embodiment, the bottom end of the bending limiting portion 1152 extends upward toward the outside of the column 11, forming a "√"-shaped support structure, providing oblique upward support for the column 11, and further enhancing the stability of the column 11.

In the present embodiment, the connecting block 3 includes a second body 32, and the second body 32 is attached to the second vertical plate 25 of the mounting crossbar 2. The upper and lower ends of the second body 32 are respectively provided with a first abutting portion 321 and a second abutting portion 322. The first abutting portion 321 and the second abutting portion 322 respectively abut against the inner sides of the second horizontal plate 26 and the third horizontal plate 27. The free end of the second abutting portion 322 is provided with a fitting portion 323, and the fitting portion 323 fits the bent plate 271. This allows the connecting block 3 to be integrally embedded within the mounting crossbar 2 and makes it feasible that the two mounting crossbars 2 are connected by the connecting block 3. Meanwhile, the mounting crossbar 2 wraps around and limits the connecting block 3, ensuring the stability of the connecting block 3 after installation. In the present embodiment, two second locking channels 325 are provided on the second body 32. The two second locking channels 325 and the two mounting crossbars 2 are in a one-to-one correspondence. The connecting block 3 locks the two mounting crossbars by the bolts 131 and the second locking channels 325.

In the present embodiment, a second embedding channel 324 is provided on the second body 32, and the level gauge 4 is embedded in the second embedding channel 324.

The above is only preferred embodiments of the present invention, but the protection scope of the present invention is not limited thereto. Any changes or replacements that can be easily thought of by a person skilled in the art within the technical scope disclosed in the present invention should be included in the protection scope of the present invention. Therefore, the protection scope of the present invention should be defined by the appended claims.

What is claimed is:

1. A modular air conditioner mounting bracket, comprising at least two sets of mutually spaced bracket mechanisms, wherein each of the two sets of bracket mechanisms comprises a column, a support assembly, and a detachable connecting member, the column is provided with a plurality of first mounting channels, and the support assembly is provided with at least one second mounting channel;

the support assembly is provided at a bottom end of the column through the detachable connecting member, and an extension direction of the support assembly is perpendicular to an extension direction of the column; the support assembly comprises a first support, a second support, and a limiting member, an adjustment channel is provided within the first support, the second support is inserted into the adjustment channel, and the limiting member is inserted into the first support and the second support.

2. The modular air conditioner mounting bracket according claim 1, wherein at least one mounting crossbar is provided at a top end of the column, and the at least one mounting crossbar is provided with a third mounting channel; one end of two mounting crossbars abut against each other and are secured by a connecting block, and a level gauge is provided on the connecting block;

the top end of the column is provided with at least one limiting notch, the at least one mounting crossbar is provided with a limiting portion, and the limiting portion is embedded in the limiting notch.

3. The modular air conditioner mounting bracket according claim 2, wherein a first hanging channel is provided on an inner side of the top end of the column, the at least one mounting crossbar is inserted into the first hanging channel, the limiting notch is provided at a top end and/or a bottom end of the first hanging channel and communicated with the first hanging channel.

4. The modular air conditioner mounting bracket according claim 3, wherein there are two limiting notches and two limiting portions, and the two limiting notches are respectively provided at the top end and the bottom end of the first hanging channel, each of the two limiting notches is an arc notch, a free end of the arc notch is bent toward an inner side of the column, each of the two limiting portions is an arc limiting portion, and the arc limiting portion is embedded in the arc notch.

5. The modular air conditioner mounting bracket according claim 4, wherein the at least one mounting crossbar comprises a first vertical plate, and a top end and a bottom end of the first vertical plate both extend outward to form first horizontal plates, the connecting block comprises a first body, two outwardly extending support plates are fixed to an inner side of the first body, and the two support plates are respectively in contact with and arranged on inner side surfaces of the two first horizontal plates;

an upper end and a lower end of the first body are both provided with bending limiting arms, and each of the bending limiting arms is bent toward the inner side of the column and wrapped around the arc limiting portions;

at least two first locking channels are provided on the first body, and the first locking channels and the two mounting crossbars are in a one-to-one correspondence.

6. The modular air conditioner mounting bracket according claim 2, wherein a second hanging channel is provided on an inner side of the top end of the column, and the limiting notch is located below the second hanging channel;

the at least one mounting crossbar comprises a second vertical plate, and a top end and a bottom end of the second vertical plate both extend outward to form a second horizontal plate and a third horizontal plate; the second horizontal plate extends to an inside of the second hanging channel, and abuts against and contacts an inner top of the second hanging channel; the second vertical plate is arranged on and in contact with an inner side surface of the column, the third horizontal plate extends to an inside of the limiting notch, the limiting notch is provided with a bending limiting portion, a free end of the third horizontal plate is provided with a bent plate, and the bent plate is embedded in the bending limiting portion.

7. The modular air conditioner mounting bracket according claim 6, wherein a bottom end of the bending limiting portion extends upward toward an outside of the column.

8. The modular air conditioner mounting bracket according claim 6, wherein the connecting block comprises a second body, an upper end and a lower end of the second body are respectively provided with a first abutting portion and a second abutting portion, the first abutting portion and the second abutting portion respectively abut against inner sides of the second horizontal plate and the third horizontal plate, a free end of the second abutting portion is provided with a fitting portion, and the fitting portion fits the bent plate.

9. The modular air conditioner mounting bracket according claim 1, wherein two sides of a bottom of the first support are provided with first guide plates, the first guide plates extend horizontally to a lower channel opening of the adjustment channel, two sides of a bottom of the second support are provided with second guide plates, the second guide plates extend horizontally relative to each other, and bottom surfaces of the second guide plates abut against and contact top surfaces of the first guide plates.

10. The modular air conditioner mounting bracket according claim 9, wherein insertion notches are provided on two sides of a bottom end of a channel opening of the adjustment channel facing the second support, a top of each of the insertion notches tilts downward from the channel opening of the adjustment channel, and the first guide plates extend from bottom ends of the insertion notches to an end of the first support.

* * * * *